US007018231B2

(12) United States Patent
Liu et al.

(10) Patent No.: US 7,018,231 B2
(45) **Date of Patent: *Mar. 28, 2006**

(54) RIGHT ANGLE CABLE END CONNECTOR ASSEMBLY AND THE METHOD OF MAKING THE SAME

(75) Inventors: Huang Hsin Liu, Tu-Chen (TW); Jie Cheng, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/841,114

(22) Filed: May 7, 2004

(65) Prior Publication Data

US 2004/0242032 A1 Dec. 2, 2004

(30) Foreign Application Priority Data

May 7, 2003 (TW) ..... 92112493 A

(51) Int. Cl.
*H01R 12/24* (2006.01)

(52) U.S. Cl. ..... 439/492; 439/604

(58) Field of Classification Search ..... 439/492, 439/499, 604

See application file for complete search history.

(56) References Cited

U.S. PATENT DOCUMENTS 6,875,048 B1 * 4/2005 Lee ..... 439/497
6,899,551 B1 * 5/2005 Vanbesien ..... 439/79

* cited by examiner

*Primary Examiner*—Khiem Nguyen
(74) *Attorney, Agent, or Firm*—Wei Te Chung

(57) ABSTRACT

A cable end connector assembly (1) includes an insulative housing (10), a number of contacts (20), a cable (40), a casing (50) and a cover (60). The insulative housing defines a L-shaped receiving space (23). The contacts are received in the insulative housing, each contact comprises a mating portion, a retention portion, and a tail portion extending rearwardly and downwardly from the retention portion. The cable comprises an insulative jacket and a number of conductive cores extending upwardly beyond an upper end of the insulative jacket and connecting with the tail portions of the contacts. A cover is over-molded with the rear portion of the insulative housing and the cable. A method for making such a cable end connector assembly is also disclosed.

9 Claims, 6 Drawing Sheets

RIGHT ANGLE CABLE END CONNECTOR ASSEMBLY AND THE METHOD OF MAKING THE SAME

BACKGROUND OF THE INVENTION

1. Field of the Invention

The present invention relates to a cable end connector assembly and a method for making the same, and more particularly to a right angle Serial ATA (Advanced Technology Attachment) cable end connector assembly and a method for making the right angle Serial ATA cable end connector assembly.

2. Description of the Related Art

There exists in the art an electrical connector assembly known as a Serial ATA cable end connector assembly which is generally used for transmitting high speed signals between storage devices and a motherboard. Because of many advantages superior to Parallel ATA, Serial ATA is replacing Parallel ATA and becomes the next transmitting generation.

Chinese Patent No. 01222349.2 discloses a right angle and straight Serial ATA cable end connector assembly. The assembly includes an insulative housing, a number of contacts disposed in the insulative housing, a cable electrically connected with the contacts, and an angled or straight cover over-molded with a rear portion of the insulative housing and a front end of the cable. However, troubles will be encountered in mating/unmating the assembly with/from a complementary connector mounted on the motherboard or back panels of the storage devices and surrounded by many other electronic components.

(1) The over-molding cover just can keep the outward appearance and prevent the external surrounding to erode the cable and contacts but can not provide a secure connection therebetween. Although the cover can supply a good adhesion force for cable and contacts at the beginning of assembly, but the adhesion force will be reduced with the using frequency and time so that the pulling force will direct transmit to cable and contacts and damage the connection therebetween.

(2) Referring to the FIG. 2, the passageways (23) is wider of the housing, during the over-molding process, the molten plastic material will easily flow into the mating section and influence the electrically connection with the complementary connector. Thus, a Serial ATA cable end connector assembly is required to resolve the problem.

Hence, an improved cable end connector assembly is required to overcome the disadvantages of the prior art.

SUMMARY OF THE INVENTION

A major object of the present invention is to provide a cable end connector assembly, which has a securely connection between a cable and contacts and increases strength connection therebetween.

Another object of the present invention is to provide a cable end connector assembly, which can prevent molten plastic material from flow into a mating section of a cable end connector assembly.

In order to achieve the object set forth, a cable end connector assembly comprises an insulative housing, a plurality of contacts, a cable, a casing and a cover. The insulative housing defines a L-shaped receiving space. The contacts are received in the insulative housing, each contact comprises a mating portion, a retention portion, and a tail portion extending rearwardly and downwardly from the retention portion. The cable comprises an insulative jacket and a plurality of conductive cores extending forwardly beyond a front end of the insulative jacket and connecting with the tail portions of the contacts; and a cover over-molded with the rear portion of the insulative housing and the cable.

Other objects, advantages and novel features of the invention will become more apparent from the following detailed description when taken in conjunction with the accompanying drawings.

DETAILED DESCRIPTION OF THE INVENTION

Figure 1:
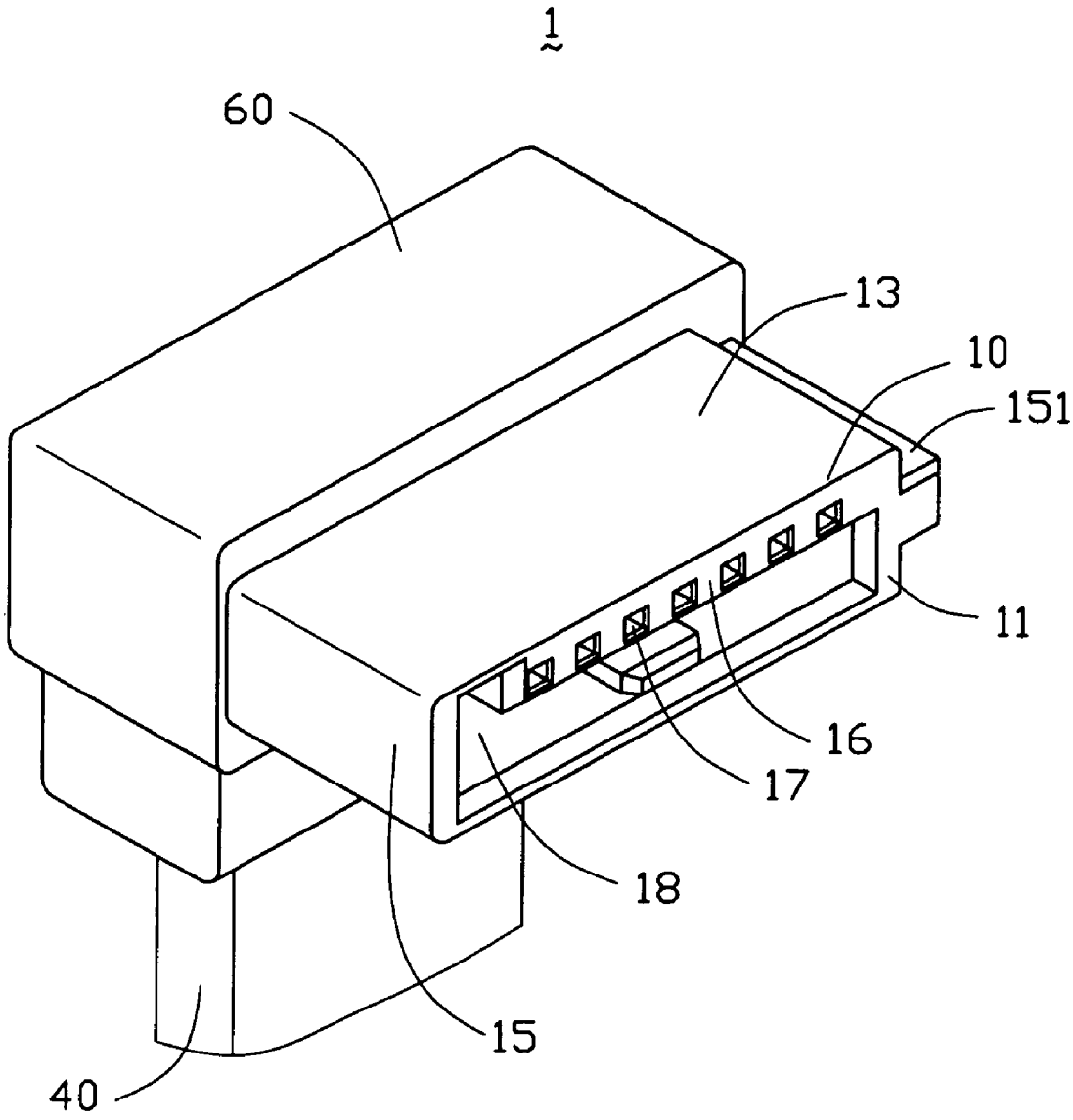
FIG. 1 is a perspective view of a cable end connector assembly in accordance with the present invention.
Figure 2:
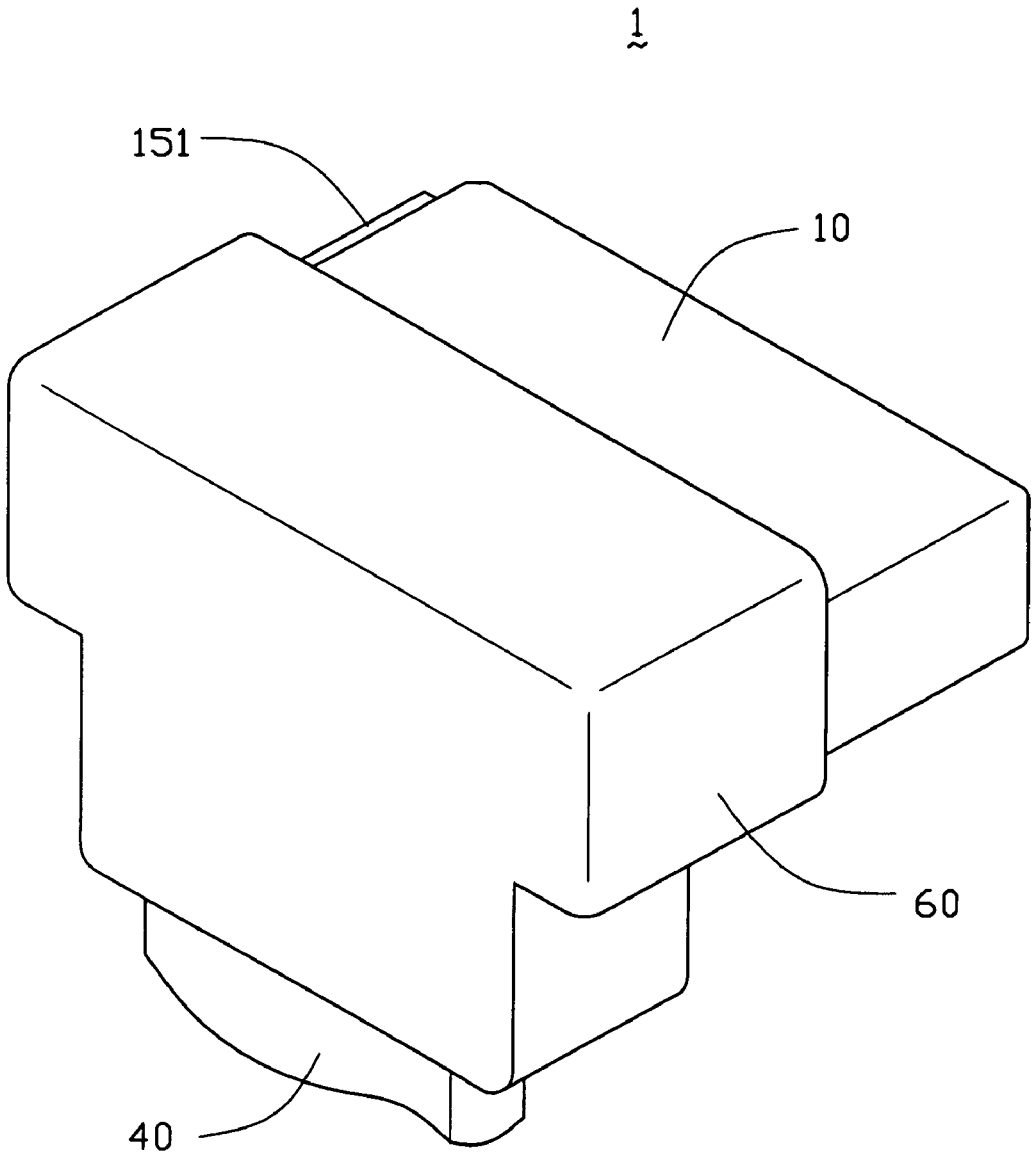
FIG. 2 is a perspective view of the cable end connector assembly of FIG. 1 taken from another aspect.
Figure 3:
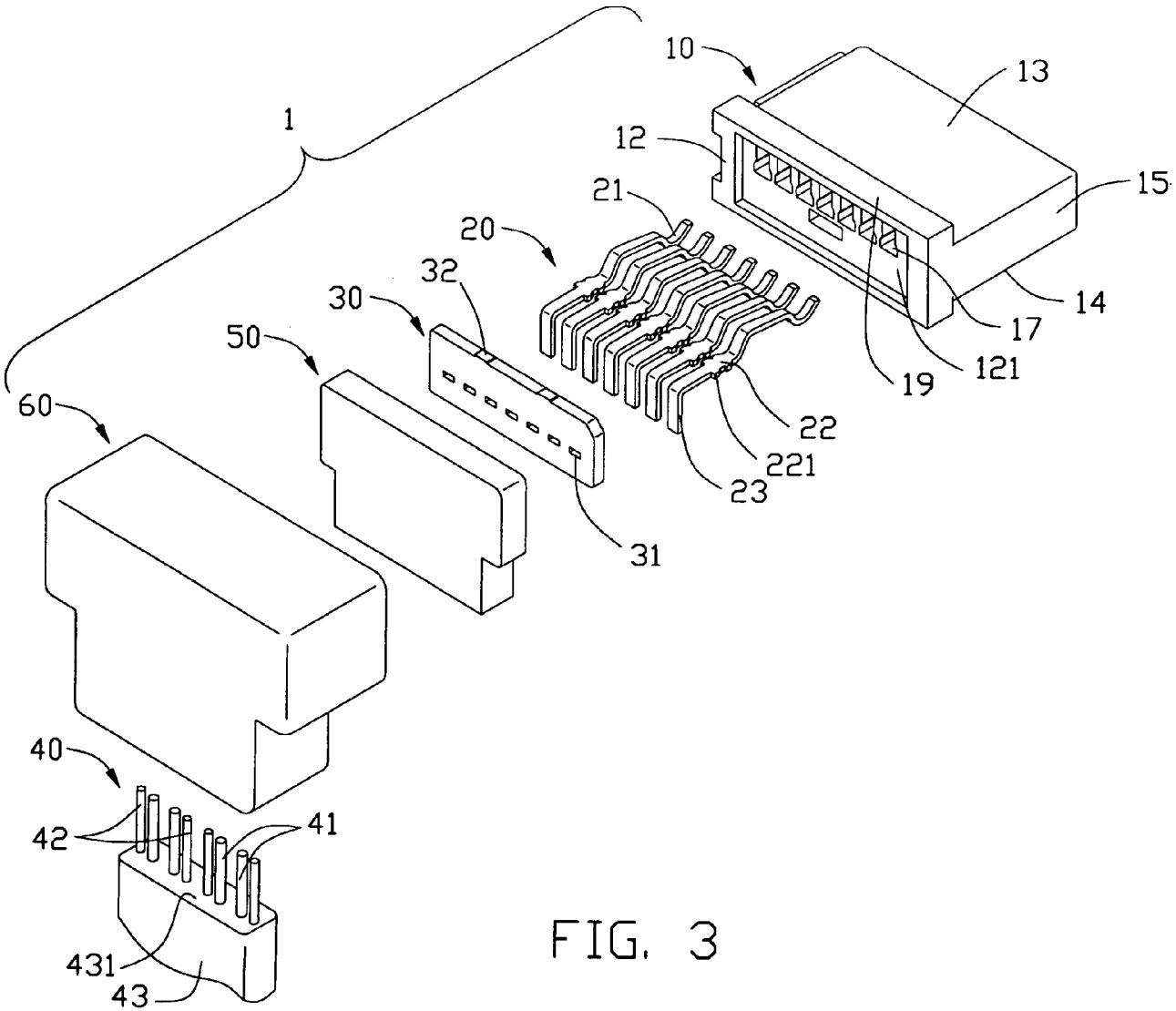
FIG. 3 is an exploded, perspective view of the cable end connector assembly of FIG. 2.

Referring to FIGS. 1 to 3, a cable end connector assembly 1 comprises an insulative housing 10, a plurality of contacts 20, a spacer 30, a cable 40, a casing 50 and a cover 60.

The insulative housing 10 comprises a front end 11, a rear end 12, opposite top and bottom walls 13, 14, and opposite side walls 15. The top, bottom and side walls together define an L-shaped receiving space 18 therebetween for receiving a mating portion of a complementary connector (not shown). The bottom wall 14 defines a plurality of passageways 17 extending through the front and the rear ends 11, 12. A block 151 projects sidewardly from an outer face of one of the side walls 15 for guiding the complementary connector. A plurality of ribs 19 project from outer faces of the top, bottom walls 13, 14 and one of the side walls 15 and are located at a rear portion of the insulative housing 10. A rectangular shaped cavity 121 is defined at the rear end 12.

The contacts 20 are parallel to each other and extend along the mating direction along which the assembly 1 is mated with the complementary connector. Each contact comprises a retention portion 22, a mating portion 21 extending forwardly from the retention portion 22, and a tail portion 23 extending rearwardly and downwardly from the retention portion 22. Each retention portion 22 is formed with a plurality of barbs on a pair of sides thereof.

The spacer 30 is a rectangular plate and comprises a plurality of openings 31 defined therein and a pair of protrusions 32 formed on an upper edge thereof.

The cable 40 comprises a plurality of conductive cores 41, an insulative jacket 43 surrounding and separating the conductive cores 41 and an upper end 431 the conductive cores 41 extending beyond therein.

The casing 50 is in the shape of a rectangular plate, which is comprised of molded plastic, preferably transparent PE (Polyethylene, PE) material in this embodiment.

The cover 60 is configured to a right angle, which is also comprised of molded plastic, preferably PVC (Polyvinyl Chloride) in this embodiment.

Figure 4:
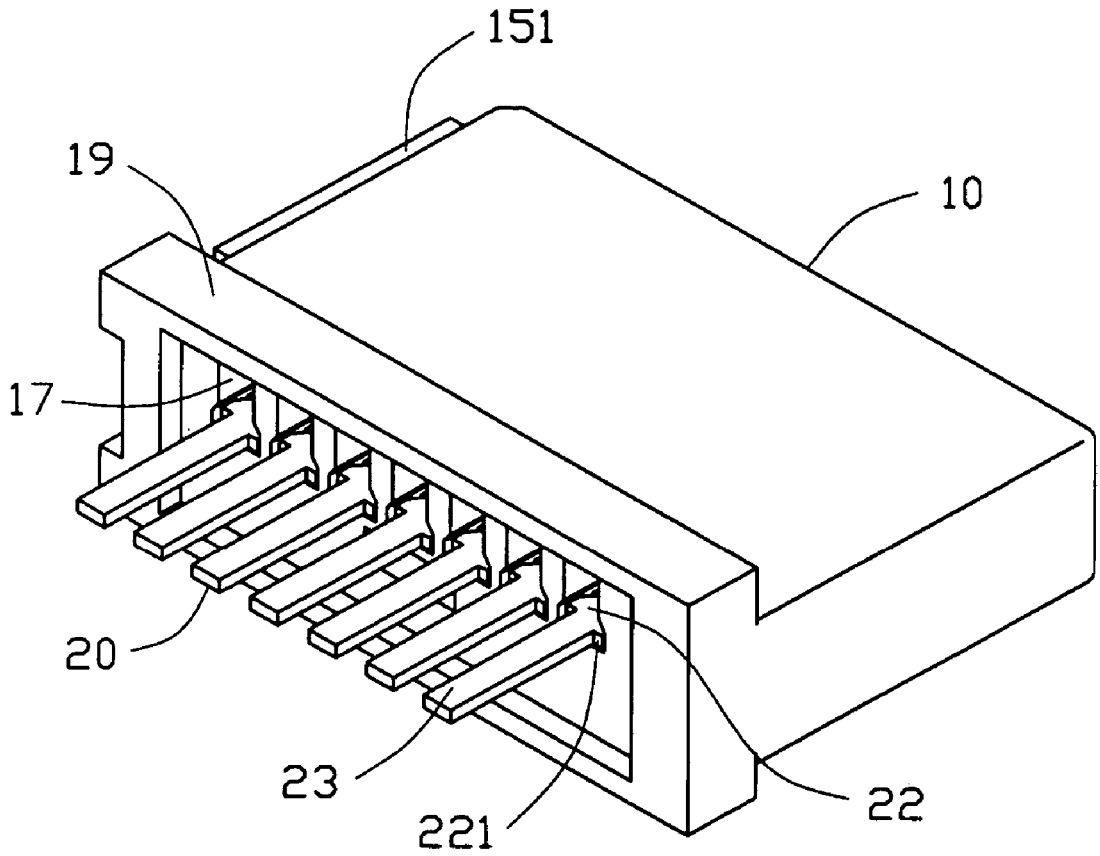
FIG. 4 is an assembled, perspective view of an insulative housing and contacts of the cable end connector assembly of FIG. 3.
Figure 5:
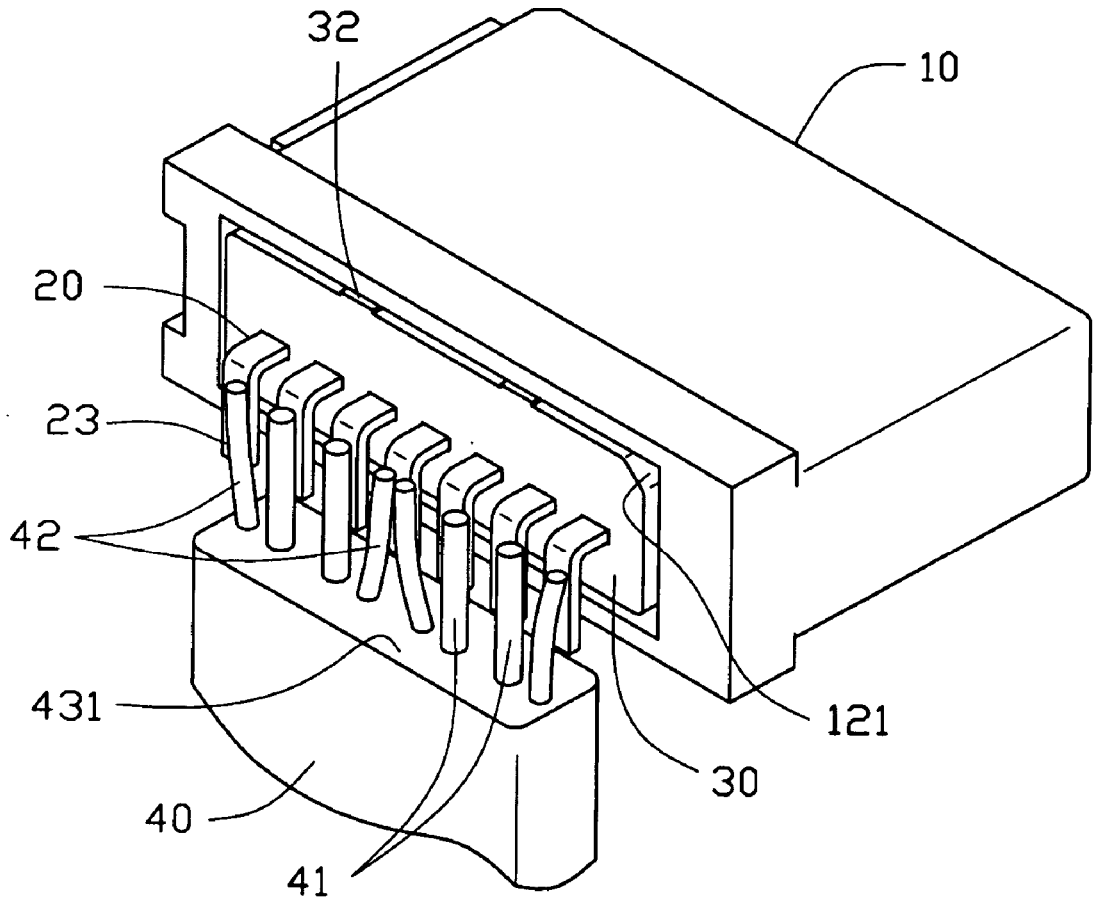
FIG. 5 is a view similar to FIG. 4, but a spacer is attached to the insulative housing, and the contacts are bent and a cable is connected with the contacts.
Figure 6:
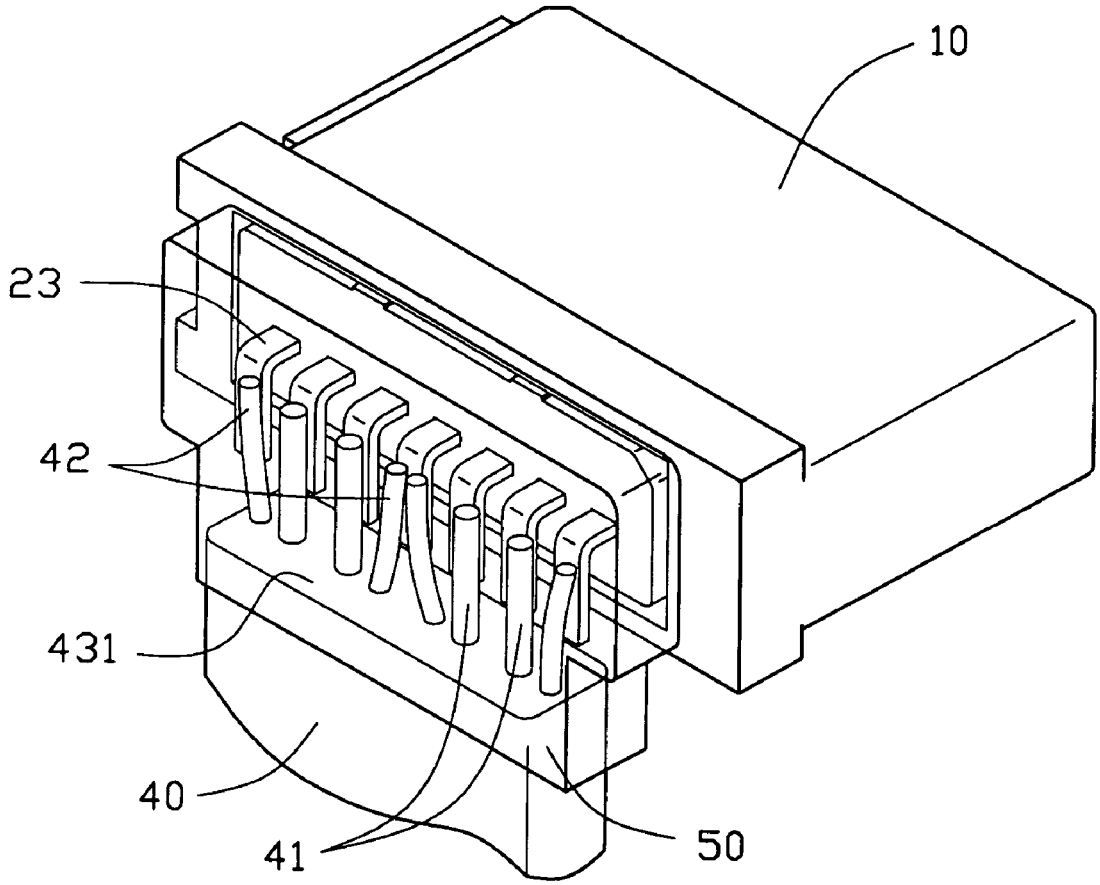
FIG. 6 is a view similar to FIG. 5, but the casing is molded with the connection area between the contacts and the cable.

In processes of manufacturing and assembling, with reference to FIG. 4–6, the contacts 20 are inserted into the passageways 17 of the insulative housing 10. The mating portions 21 and the retention portions 22 are both received in the corresponding passageways 17 with the barbs 221 fittingly engaging with the side walls (not shown) of the passageways 17. The tail portions 23 extend out of the corresponding passageways 17 and are bent downwardly for soldering with the conductive cores 41 of the cable 40. With reference to FIG. 5, the spacer 30 is assembled in the cavity 121 of the insulative housing 10 with the openings 31 fittingly receiving the respective contacts 20 and the protrusions 32 snugly abutting against a top surface of the cavity 121 for securing the spacer 30 in the cavity 121. Thus, the spacer 30 seals one end of each passageway 17 so as to prevent the melted plastic material of the casing 50 and the cover 60 from entering into the housing 10 to influence the electrical connection between the cable end connector assembly 1 and the complementary connector.

Also referring to FIG. 5, the conductive cores 41 of the cable 40 are respectively soldered with the tail portions 23 of the contacts 20 for establishing an electrical connection therebetween. With reference to FIG. 6, the casing 50 is molded with the connection area between the contacts and the cable to ensure the connection reliable. Returning to FIG. 2, the cover 60 is over-molded with the insulative housing 10, the casing 50, the upper end 431, and a part of the cable 40. The cover 60 engages with the ribs 19 for preventing it moving in a front-to-rear direction.

In the present invention, the casing 50 is made of PE, this kind of material can provide a secure connection between the cable 40 and the tail portions 23 of the contacts. When the cable is pulled, the pulling force will be direct transmitted to the cover 60, therefore, the pulling action will not influence the firmly connection between the cable 40 and the tail portions 23 of the contacts. The cable end connector assembly 1 can be easy depart from the complementary connector by the ribs 19 of the insulative housing 10. The spacer 30 can prevent the molten PVC and PE of the cover 60 and the casing 50 from entering into the housing 10 to influence the electrical connection between the cable end connector assembly 1 and the complementary connector.

Due to the over-molding process of the cover 60 have higher temperature of melted plastic material and lower injecting force than the casing 50, whereby the connection between cable 40 and the tail portions 23 of the contacts can not be damaged during the over-molding process of the cover 60.

In alternative embodiments of the cable end connector assembly, the casing may not be bent at a right angle structure. The structure can be used in straight and bent cable end connector assembly. Therefore, the cable end connector assembly can get the same effects as obtained by the above embodiment. In addition, the cable may be bent at any other angle expect for the right angle as desired.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly comprising:

an insulative housing defining a L-shaped receiving space;

a plurality of contacts received in the insulative housing, each contact comprising a mating portion, a retention portion , and a tail portion extending rearwardly and downwardly from the retention portion;

a cable comprising an insulative jacket and a plurality of conductive cores extending upwardly beyond an upper end of the insulative jacket and connecting with the tail portions of the contacts; and a cover over-molded with the rear portion of the insulative housing and the cable.

2. The cable end connector assembly as claimed in claim 1, further comprising a casing molded with a connection area between the contacts and the upper end of the cable and over-molded by the cover.

3. the cable end connector assembly as claimed in claim 1, wherein the cover is molded with the tail portions of the contacts, the conductive cores and a part of insulative jacket of the cable.

4. the cable connector assembly as claimed in claim 1, wherein the insulative housing is formed with a plurality of ribs, on outer faces of the rear portion thereof, enclosed by the cover.

5. the cable end connector assembly as claimed in claim 1, wherein the insulative housing defines a plurality of passageways therein, and wherein the contacts are received in the passageways, respectively.

6. the cable end connector assembly as claimed in claim 1, further comprising a spacer assembled in the rear portion of the insulative housing for sealing the passageways, the spacer comprising a plurality of openings defined therein for extension of corresponding contacts therethrough and a protrusion snugly engaging with the insulative housing.

7. the cable end connector assembly as claimed in claim 6, the tail portions of the contacts extend through the openings of the spacer and is bent perpendicularly.

8. a cable end connector assembly comprising:

an insulative housing defining a receiving space;

a plurality of contacts received in the insulative housing, each contact comprising a mating portion, a retention portion, and an L-shaped tail portion extending rearwardly and downwardly from the retention portion;

a spacer retained on horizontal sections of the L-shaped tail portions of the said contacts;

a cable comprising an insulative jacket and a plurality of conductive cores extending upwardly beyond an upper end of the insulative jacket and connecting with vertical sections of the tail portions of the contacts;

a casing enclosing the conductive cores and the vertical sections of the tail portions, and a cover enclosing said casing.

9. A cable end connector assembly comprising:

an insulative housing defining a L-shaped receiving space;

a plurality of contacts received in the insulative housing, each contact comprising a mating portion, a retention portion , and a tail portion extending rearwardly from the retention portion;

a cable comprising an insulative jacket and a plurality of conductive cores extending beyond a front end of the insulative jacket and connecting with the tail portions of the contacts;

a casing molded with a connection area between the contacts and the cable; and a cover enclosing the casing.

* * * * *